US006712016B1

(12) United States Patent
Morisch et al.

(10) Patent No.: US 6,712,016 B1
(45) Date of Patent: Mar. 30, 2004

(54) PERSONAL WATERCRAFT HAVING VENTILATED SPONSONS

(75) Inventors: Bradley R. Morisch, Okoboji, IA (US); Dallas B. Wynne, Spirit Lake, IA (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 10/237,147

(22) Filed: Sep. 6, 2002

(51) Int. Cl.[7] ..... B63B 39/06
(52) U.S. Cl. ..... 114/126; 114/59.54; 114/284
(58) Field of Search ..... 114/56.1, 55.5, 114/55.54, 284, 121, 122, 123, 126, 129, 343

(56) References Cited

U.S. PATENT DOCUMENTS

| | | | | |
|---|---|---|---|---|
| 731,515 | A | 6/1903 | Sheen et al. | 114/123 |
| 998,437 | A | 7/1911 | Wieland | 114/123 |
| 2,448,075 | A | 8/1948 | Bortner | 244/102 |
| 2,919,669 | A | 1/1960 | Kikuhara | 114/123 |
| 3,369,518 | A | 2/1968 | Jacobson | 114/123 |
| 3,481,297 | A | 12/1969 | Mantle | 114/67 |
| 3,485,198 | A | 12/1969 | Matthews | 114/123 |
| 3,648,641 | A | 3/1972 | Normand, Jr. | 114/123 |
| 3,702,106 | A | 11/1972 | Wilder | 114/123 |
| 3,707,936 | A | 1/1973 | Harris | 114/126 |
| 4,320,713 | A | 3/1982 | Nishida et al. | 114/123 |
| 4,690,094 | A | 9/1987 | Taylor | 114/284 |
| 4,942,837 | A | 7/1990 | Hellmann et al. | 114/40 |
| 4,964,357 | A | 10/1990 | Genfan | 114/274 |
| 5,544,607 | A | 8/1996 | Rorabaugh et al. | 114/123 |
| 5,713,297 | A * | 2/1998 | Tani et al. | 114/284 |
| 5,908,006 | A * | 6/1999 | Ibata | 114/284 |
| 6,041,727 | A * | 3/2000 | Yamada et al. | 114/123 |
| 6,105,527 | A | 8/2000 | Lochtefeld et al. | 114/125 |
| 6,379,204 | B2 * | 4/2002 | Bolen | 441/79 |
| 6,523,490 | B1 * | 2/2003 | Watkins | 114/55.54 |
| 6,546,888 | B2 * | 4/2003 | Bertrand et al. | 114/126 |

* cited by examiner

*Primary Examiner*—S. Joseph Morano
*Assistant Examiner*—Lars A. Olson
(74) *Attorney, Agent, or Firm*—Fredrickson & Byron, P.A.

(57) ABSTRACT

Ventilated sponsons, personal watercraft having ventilated sponsons, and methods for adjusting the handling characteristics of personal watercraft by ventilating the sponsons. The present invention provides ventilated sponsons, sponsons, having holes formed through the sponsons to allow high pressure water trapped under the sponson to escape. The holes formed through the sponson thus allow for fine tuning and adjusting the performance characteristics and handling characteristics of the personal watercraft long after the point of manufacture. Ventilating the sponsons can increase straight line stability while maintaining tight cornering characteristics.

21 Claims, 4 Drawing Sheets

PERSONAL WATERCRAFT HAVING VENTILATED SPONSONS

FIELD OF THE INVENTION

The present invention is related generally to personal watercraft. More specifically, the present invention is related to personal watercraft having adjustable sponsons.

BACKGROUND OF THE INVENTION

Personal watercraft have become increasingly popular in recent years. A personal watercraft, also known as a "jet ski" typically has a bottom hull, handle bars for steering, a tunnel within the bottom hull, a jet pump located within the bottom tunnel, and an engine within the hull under the top deck for driving the jet pump. The jet pump typically pulls in water from the front of the tunnel under the boat, and discharges the water at high velocity through a steerable nozzle at the rear of the boat. The handle bars are typically coupled to the nozzle, which is the steering mechanism for the personal watercraft. The watercraft commonly has a straddle-type seat and foot wells disposed on either side of the seat.

Early watercraft often had longitudinal chines running underneath the bottom hull, and sometimes had steps located in the rear portion of the bottom hull, for reducing porpoising by extending the length of the boat while not extending the length of wetted surface. Steering, as previously indicated, was primarily effected by turning the handle bars coupled to the nozzle, which could be steered from side to side to direct the water jet in the desired direction and thereby steer the personal watercraft. The steerable nozzle sometimes had a small rudder on the nozzle, also for aiding in steering the watercraft.

Early personal watercraft sometimes skidded around corners wider than the driver desired. Sometimes, boats would turn 180°, despite the driver's intent to make a sharp 90° turn. This lack of control at high speeds during aggressive maneuvers was later addressed by adding sponsons to the personal watercraft.

The term "sponson" has come to have different meanings in different contexts. Historically, sponsons were floatation devices or outriggers for stabilizing a boat in rough water. The sponsons could be lowered to stabilize a boat in rough water, for example, while fishing. The sponsons could be later raised for traveling through the water. The term sponson has also been used to refer to the outrigger on an outrigger canoe. As used in the personal watercraft industry, and as used in the present application, the term sponson refers to a device having a generally hydrodynamic shape to aid in the watercraft in stabilizing straight ahead progress through the water and to aid in executing turns in the water. The personal watercraft sponsons are dimensioned and configured to have a fin or blade having an outwardly extending edge that penetrates below the water level during normal use. The personal watercraft's sponson will penetrate below the water surface when the personal watercraft is at rest, in calm water, even with no rider on board. The sponson typically has an outwardly extending lower surface that rides on the water when the boat is planing.

Sponsons provide lift at the rear of the personal watercraft, acting to force the nose down to provide a degree of aggressiveness. Sponsons that provide harder, sharper cornering often also provide decreased straight line stability. The more aggressive design often has a "tippy" feeling when the rider shifts their weight. This tippy feeling is accepted by experienced drivers, but maybe unsettling to inexperienced drivers. Sponsons are typically designed together with the personal watercraft hull, for a particular model and year. Various considerations go into the hull and sponson design, including the desired degree of stability, desired lift provided by the sponson, and the degree of aggressiveness desired for that model and model year. Different drivers desiring different features can select varying personal watercraft having the desired handling characteristics.

What would be desirable are personal watercraft having sponsons which can vary according to the desired handling characteristics of the driver. What would be advantageous are sponsons which can be changed from an aggressive handling mode to a gentle riding mode.

SUMMARY OF THE INVENTION

The present invention provides ventilated sponsons, personal watercraft having ventilated sponsons, and methods for changing the handling characteristics of personal watercraft by forming holes in the sponsons. The present invention provides personal watercraft having sponsons that can extend outwardly and downwardly away from the hull of the personal watercraft, and have a downward and outwardmost edge for penetrating beneath the water surface during use. The sponson body can have at least one hole formed through the body to relieve pressure formed along the underside of the sponson body. The holes' diameter can vary with the particular embodiment. In some embodiments, the hole varies between about one-half inch and about one inch in diameter. The number of holes in some embodiments vary between one hole per sponson and about 5 holes per sponson.

Sponsons typically provide lift at the rear of a personal watercraft, raising the stern and lowering the bow, to provide a more aggressive handling and cornering machine. The outer edges of the sponson provide straightline stability by acting as a fixed rudder on either side of the hull. The outermost edges of the sponson also provide for tighter cornering by digging into the water during turns. In some situations, the driver may wish for improved straightline stability for a particular machine. Rather than being stuck with the particular handling characteristics of the particular personal watercraft, the present invention provides methods for adjusting the handling characteristics of the personal watercraft. Holes can be formed through the sponson body, to the underside of the sponson, to bleed off pressure formed along the underside of the sponson. In normal use, when the personal watercraft is planing, substantial water pressure is built up under the sponson, with a sponson horizontal surface typically riding on the surface of the water. Holes can be formed through the sponson body to allow a spray of water to exit through the hole, thereby relieving the pressure in the rear of the watercraft, thereby raising the nose of the watercraft. In some watercraft, the holes are between about one-half inch and one inch in diameter. In some sponsons, the holes have a pitch of about 10 degrees upward from a rearward facing horizontal direction and an outward angle of about 30 degrees away from a directly rearward facing orientation.

DETAILED DESCRIPTION OF THE PREFERRED EMBODIMENTS

The following detailed description should be read with reference to the drawings, in which like elements in different drawings are numbered identically. The drawings, which are not necessarily to scale, depict selected embodiments and are not intended to limit the scope of the invention. Several forms of invention have been shown and described, and other forms will now be apparent to those skilled in art. It will be understood that embodiments shown in drawings and described above are merely for illustrative purposes, and are not intended to limit scope of the invention as defined in the claims which follow.

Figure 1:
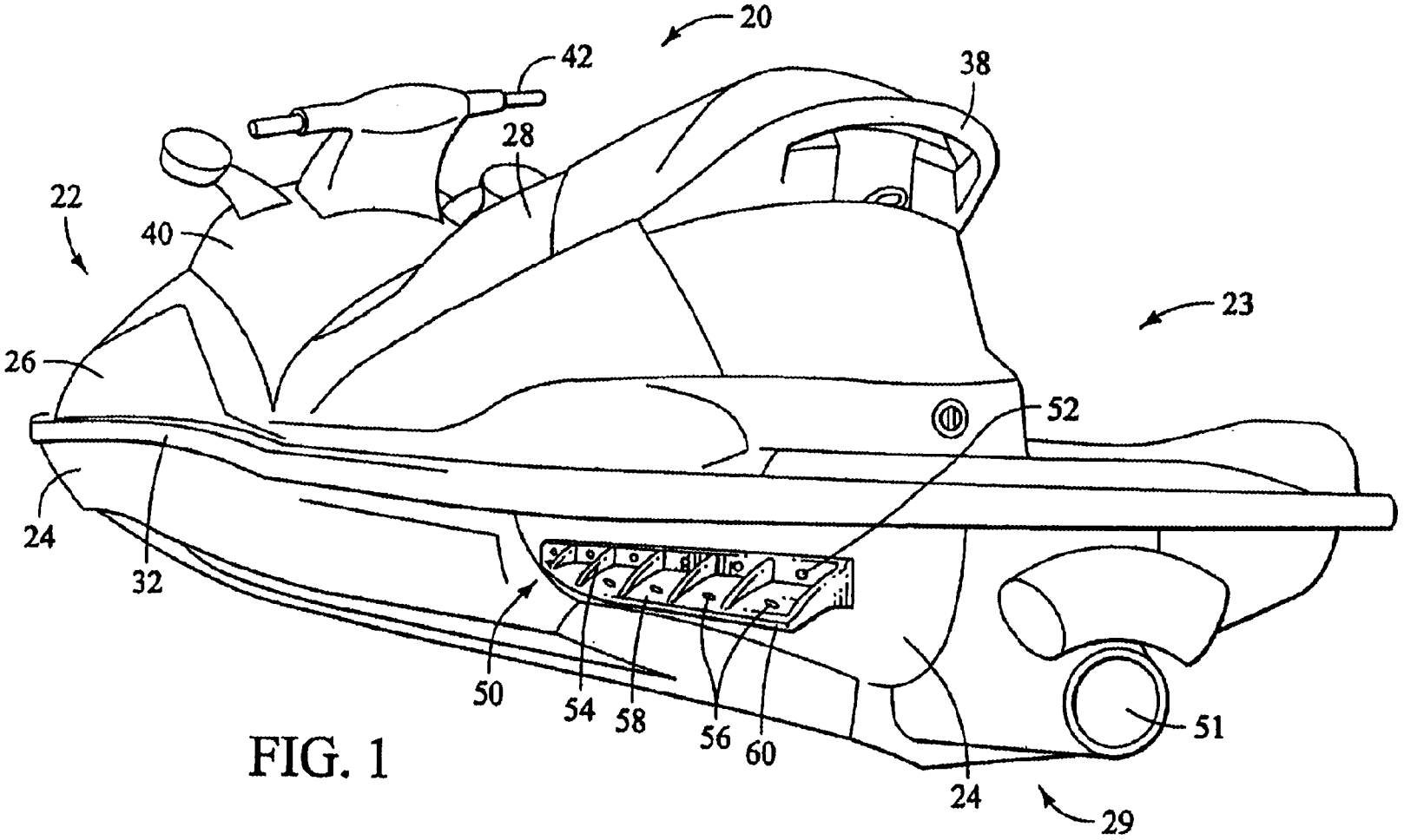
FIG. 1 is a rear, perspective view of a personal watercraft having curved, ventilated sponsons.

FIG. 1 illustrates a personal watercraft 20 having generally a front or bow 22 and a rear or stern 23. Personal watercraft 20 includes a bottom hull 24 secured to a top deck 26 along an overlapping portion covered with a rub rail 32 in the embodiment illustrated forming a hull.

The hull formed by the bottom hull 24 and top deck 26 define a compartment sized to contain an internal combustion engine for powering the watercraft, and may also include one or more storage compartments, depending upon the size and configuration of the watercraft. The deck portion 26 also has a raised, longitudinally extending seat 28 adapted to accommodate one or more rider seated in straddle fashion on the seat 28. The engine powers a jet propulsion unit 29, typically mounted in a tunnel at the bottom rear portion of the watercraft. The jet propulsion unit 29 includes a steerable water discharge nozzle 51 that is operatively connected to a set of handlebars 42 to facilitate steering of the watercraft by the operator. The handlebars 42 typically mount through a top portion of a shroud 40. Connection between the handlebars 42 and the discharge nozzle 51 may be of any suitable type, and typically includes mechanical linkages including a control cable. If desired, an electronic connection could also be utilized.

FIG. 1 illustrates a ventilated sponson 50. Ventilated sponson 50 includes generally a curves sponson fin being curved outwardly and downwardly away from hull 24. Ventilated sponson 50 includes mounting holes 52 for mounting the sponson to hull 24. Ventilated sponson 50 may be seen to have numerous braces or ribs 54 for providing support and structural strength to the sponson 50. Downwardly curved, inter-rib portions 58 separate the ribs 54. Inter-rib sponson portions 58 may be seen to include a plurality of holes 56 formed through the sponson. Holes 56 may be seen to be partially or entirely open through the sponson. Holes 56 can provide a path for water trapped on the underside of the sponson to exit to the upper or outside of the sponson through the sponson body. Sponson 50 may be seen to include an outward or downward-most edge 60 that penetrates the water surface. In a preferred embodiment, ventilated sponson 50 is dimensioned, configured and mounted on hull 24 such that sponson edge 60 lies beneath the water surface when personal watercraft 20 is at rest or in calm water, even with no passengers. Sponson 50 thus provides a hydrodynamic steering function, rather than a flotation function. In a preferred embodiment, ventilated sponson 50 is formed of a material, such as polypropylene, which is heavier than water and thus does not float. Sponson 50 may also be formed in a manner so as to be non-buoyant.

Figure 2:
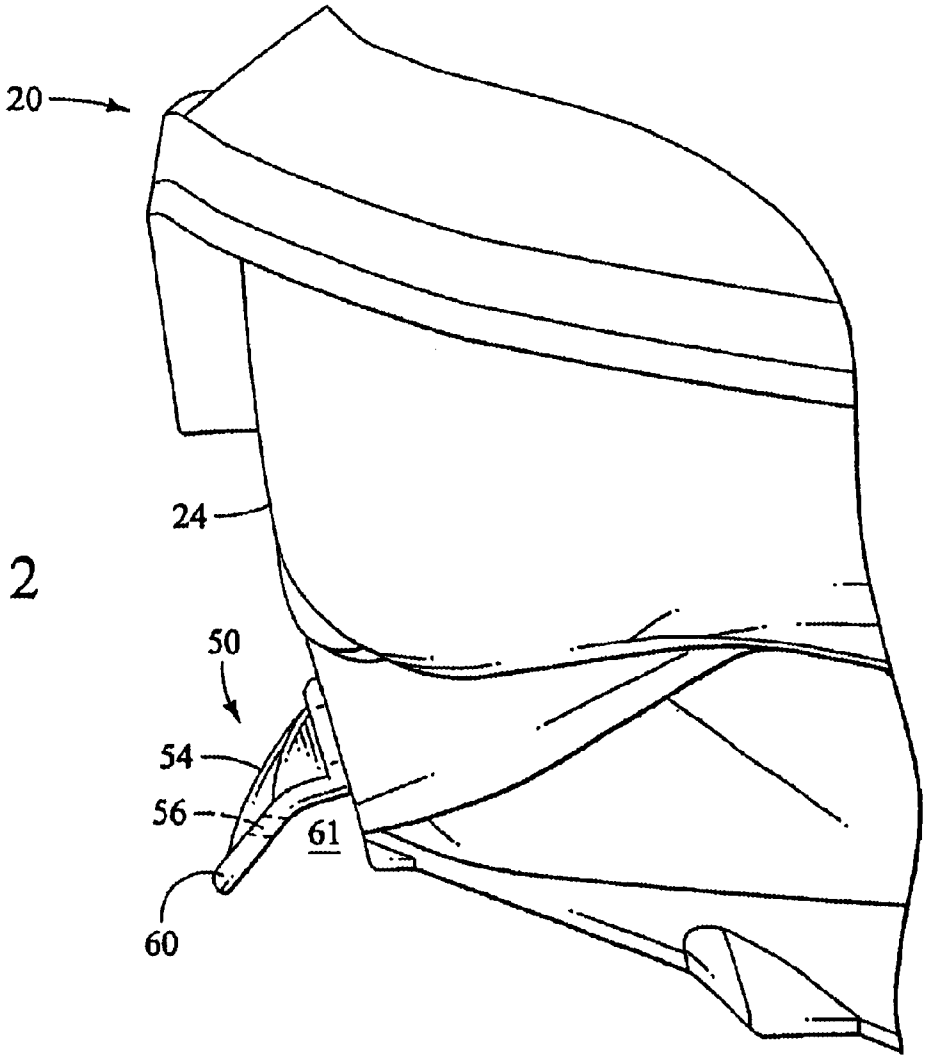
FIG. 2 is a fragmentary, rear view of the curved, ventilated sponson of FIG. 1, having a hole through the sponson shown in phantom.

FIG. 2 illustrates a portion of personal watercraft 20 from the rear, illustrating ventilated sponson 50 in greater detail. Ventilated sponson 50 may be seen to include downward and outward-most extending edge 60, as well as a concave region 61 which can trap water beneath sponson 50. Hole 56 may be seen to provide an egress path for water trapped under sponson 50 in concave region 161. As may be seen from inspection of FIG. 2, hole 56 is angled upward relative to horizontal, as it is in a preferred embodiment of the present invention.

Figure 3:
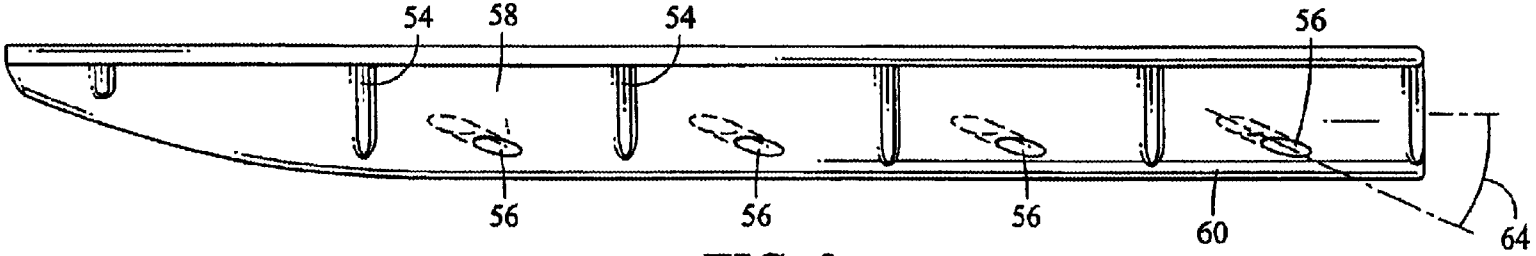
FIG. 3 is a top view of one sponson from FIG. 1 illustrating the outward angle of the holes through the sponson.

FIG. 3 illustrates a top view of sponson 50 from FIG. 1, further illustrating ribs 54, inter-rib regions 58, and holes 56. Holes 56 are illustrated forming an angle (indicated at 64) relative to a vertical plane drawn through the sponson or watercraft. In a preferred embodiment, holes 56 are formed so as to form an angle of between about 10 and 40 degrees, most preferably about 30 degrees, away from a vertical plan drawn through the sponson, relative to a directly rearward facing hole. The holes are preferably round, but being illustrated as elliptical in FIG. 3 due to the curved surface into which the round holes are formed. In some sponsons, the holes are about ¾ inch in diameter and spaced about 2–4 inches apart.

Figure 4:
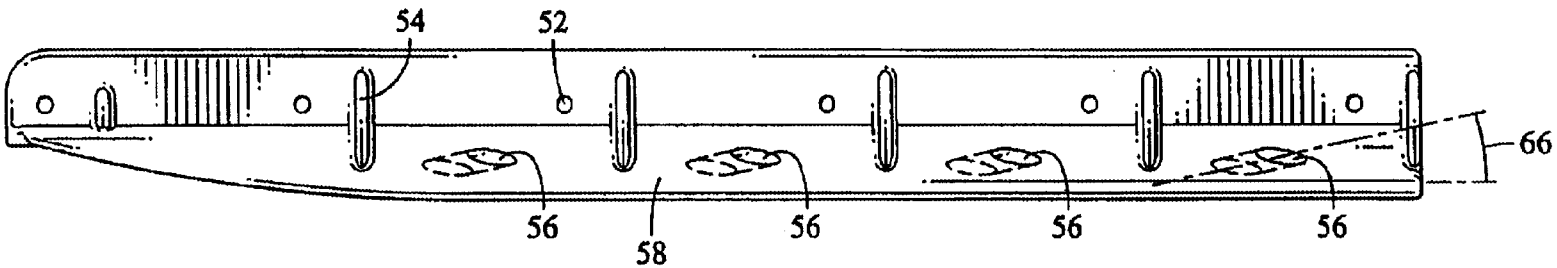
FIG. 4 illustrates the sponson of FIG. 1 from a side view, illustrating the upward angle of the holes through the sponson.

FIG. 4 illustrates a side view of the ventilated sponsons of FIGS. 1 and 3. FIG. 3 illustrates that holes 56 can form an angle as indicated at 66, relative to a horizontal plane drawn through the sponsons. In a preferred embodiment, holes 56 form an angle of between about 5 and 20 degrees upward of horizontal, most preferably about 10 degrees upward. The holes can thus form an angle of about 10 degrees upward from horizontal and about 30 degrees forward and outward of a rear vertical plane through the sponson.

Figure 5:
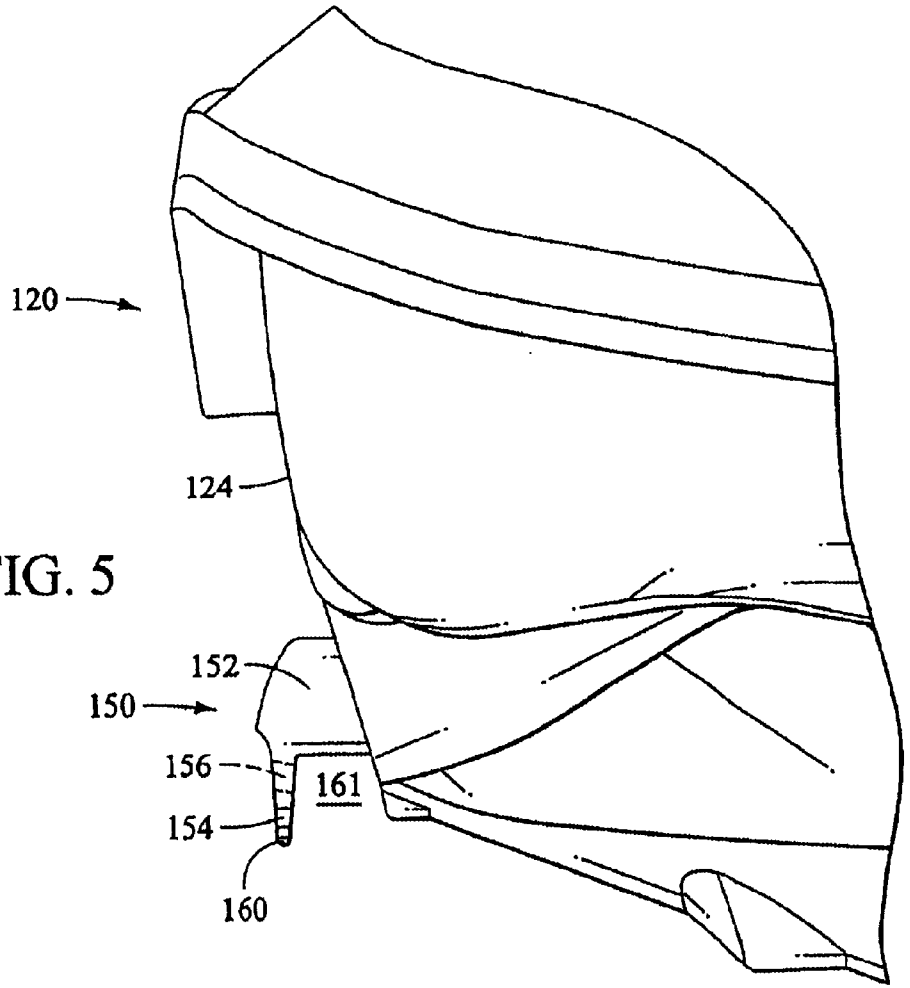
FIG. 5 is a fragmentary, rear view of another personal watercraft having a ventilated sponson including an outwardly extending portion and a downwardly extending fin portion.

FIG. 5 illustrates a portion of another watercraft 120 having a ventilated sponson 150 affixed to the bottom hull 124. Ventilated sponson 150 includes generally a horizontally or outwardly extending portion 152 continuing onto a downwardly extending portion or fin 154, terminating in a downwardmost edge of the fin at 160. A hole 156 may be seen formed through fin 154. A cavity 161 may be seen formed under ventilated sponson 150, illustrating the location in which high pressure water can be trapped during travel. The high pressure travel can exit through hole 156.

The present invention includes methods for modifying the handling characteristics of a personal watercraft, both at the factory and after delivery to a user. A sponson not ventilated or minimally ventilated may provide aggressive handling and tight cornering characteristics. The sponsons may also provide less stability than desired by the driver.

In particular, the lift provided by water trapped under the sponson out plane speeds may be larger than the driver desires, providing less than desired straight-line stability. Holes can be formed in the sponson to bleed off some of the pressure. Some water could spray out of the holes decreasing lift, and raising the nose of the watercraft, straight-line stability can be increased while maintaining tight cornering characteristics.

What is claimed is:

1. A jet-propelled personal watercraft comprising:

a hull having a bottom hull for placement in water having a water surface and a top deck secured over the bottom hull, the hull defining an engine compartment sized to contain an internal combustion engine for powering a jet propulsion unit, the jet propulsion unit including a steerable water discharge nozzle, the top deck having a raised, longitudinally extending seat adapted to accommodate an operator in straddle fashion, at least one sponson secured to either side of the bottom hull, the sponson extending outward and downward from the hull and including a fin having an outward edge for penetrating beneath the water surface, and the sponson having an outer surface and at least one open hole formed through the sponson, wherein the at least one open hole provides a path between the water surface and the sponson outer surface.

2. The watercraft as in claim 1, wherein the sponson at least one hole numbers at least three holes formed through the sponson.

3. The watercraft as in claim 1, wherein the at least one hole is angled upward relative to horizontal.

4. The watercraft as in claim 3, wherein the at least one hole is angled upward between about 5 degrees and 20 degrees from horizontal.

5. The watercraft as in claim 1, wherein the at least one hole is angled outward and forward relative to a directly rearward-facing hole, by an angle of between about 10 degrees and 40 degrees.

6. The watercraft as in claim 5, wherein the at least one hole is angled forward and outward from a directly rearward-facing axis by an angle of about 30 degrees.

7. The watercraft as in claim 1, wherein the at least one hole is between about one-half inch and about 1 inch diameter.

8. The watercraft as in claim 1, wherein the bottom hull has two sponsons secured thereto on opposite sides of the bottom hull.

9. A method for changing the handling characteristics of a personal watercraft having a hull for placement in water having a water surface and at least one sponson attached to each side of the hull, wherein the sponson has an underside and an outwardly and downwardly extending portion including a fin having an outward edge for penetrating beneath the water surface, the method comprising forming at least one hole in the sponson through to the underside of the sponson.

10. A method as in claim 9, wherein the at least one hole has a diameter of between about one-half inch and about one inch.

11. A method as in claim 9, wherein the at least one hole numbers at least three on each sponson having holes.

12. A method as in claim 9, wherein the at least one hole is formed in a substantially horizontal portion of the sponson.

13. A method as in claim 9, wherein the at least one hole is formed in a substantially vertically extending portion of the sponson.

14. A sponson for securing to a hull of a water jet-propelled personal watercraft, where the hull is configured for placement in water having a water surface, the sponson comprising a sponson body including an outwardly and downwardly extending portion terminating in a downward and outward edge for penetrating beneath the water surface, the sponson further comprising at least one hole formed through the sponson body through to the underside of the body facing the water surface.

15. A sponson as in claim 14, wherein the at least one hole has a diameter of between about one-half inch and about one inch.

16. A sponson as in claim 14, wherein the at least one hole numbers at least three holes in each sponson having holes.

17. A sponson as in claim 14, wherein the sponson at least one hole is a rearward facing having an angle relative to vertical of between about 5 degrees and 20 degrees.

18. A sponson as in claim 14, wherein the sponson at least one hole has an angle relative to horizontal of about 10 degrees.

19. A sponson as in claim 14, wherein the at least one hole has an angle relative to a directly rearwardly facing axis of between about 10 degrees and 40 degrees outward from the hull.

20. A sponson as in claim 14, wherein the sponson at least one hole is angled about 30 degrees away from a vertical rearward plane extending from the personal watercraft.

21. A sponson as in claim 14, wherein the sponson at least one hole extends about 10 degrees upwards from horizontal and about 30 degrees outward and rearward from a vertical plane extending rearward of the watercraft.

* * * * *